US006045333A

United States Patent [19]

Breit

[11] Patent Number: 6,045,333

[45] Date of Patent: Apr. 4, 2000

[54] METHOD AND APPARATUS FOR CONTROLLING A SUBMERGIBLE PUMPING SYSTEM

[75] Inventor: Stephen M. Breit, Bartlesville, Okla.

[73] Assignee: Camco International, Inc., Houston, Tex.

[21] Appl. No.: 08/980,929

[22] Filed: Dec. 1, 1997

[51] Int. Cl.[7] ..... F04B 49/06

[52] U.S. Cl. ..... 417/44.1; 417/53; 417/42; 417/43

[58] Field of Search ..... 417/44.1, 42, 43, 417/53

[56] References Cited

U.S. PATENT DOCUMENTS

| | | | |
|---|---|---|---|
| 4,687,054 | 8/1987 | Russell et al. | 166/66.4 |
| 5,049,046 | 9/1991 | Escue et al. | 417/411 |
| 5,179,306 | 1/1993 | Nasar | 310/14 |
| 5,193,985 | 3/1993 | Escue et al. | 417/53 |
| 5,708,337 | 1/1998 | Breit et al. | 318/439 |

*Primary Examiner*—Charles G. Freay
*Assistant Examiner*—Ehud Gartenberg
*Attorney, Agent, or Firm*—Fletcher, Yoder & Van Someren

[57] ABSTRACT

A submergible pumping unit for raising viscous fluids from a well is driven by an electronic drive and control system, a first portion of which is located above the well, and a second portion of which is coupled to the submergible pumping unit. The drive and control system includes a power supply circuit located above the well for converting AC power from a source to DC power having current and voltage levels. The DC power is transmitted to the pumping unit via a two-conductor DC bus cable. The pumping unit includes a switching circuit which receives the DC power for driving a submergible motor, such as a permanent magnet brushless motor. The speed of the motor, and of a pump coupled thereto, is proportional to the voltage of the DC power applied to the pumping unit. The pump is preferably a progressive cavity pump, and the drive and control circuitry provides sufficient torque to start the pump from a static condition. A control circuit is provided for transmitting configuration and desired flow rate and speed data to the power supply.

30 Claims, 7 Drawing Sheets

METHOD AND APPARATUS FOR CONTROLLING A SUBMERGIBLE PUMPING SYSTEM

BACKGROUND OF THE INVENTION

1. Field Of The Invention

The present invention relates generally to the field of submergible pumping systems for producing fluids from wells, particularly petroleum production wells. More particularly, the invention relates to a novel technique for driving and controlling a submergible pumping system at a range of speeds, thereby permitting flow rates from the pumping system to be varied. The system is particularly well suited for driving pumping systems including progressive cavity pumps and similar devices having relatively high starting and low speed torque requirements.

2. Description Of The Related Art

A variety of systems are known for producing viscous fluids from petroleum production wells and the like. Where the well formations provide sufficient pressure to raise wellbore fluids to the earth's surface without the aid of pumps, the well may be exploited directly, such as by appropriately equipping the wellhead with valving, transfer conduits, and so forth. However, in many production wells pressures are insufficient to raise the production fluids to an above-ground collection point. Consequently, pumping systems are often employed within the well for drawing the fluids from the well formations, separating the fluids in situ, if required, and raising the production fluids to the earth's surface for subsequent collection and processing.

In one known class of pumping systems of this type, a submergible pumping unit is immersed in the wellbore fluids and driven to force fluids through a production conduit to the earth's surface. Such systems typically include a submergible electric motor, a production pump, and related equipment for protecting the motor and sealing portions of the wellbore where necessary. Such systems may also include fluid or gas separators, injection pumps, and other ancillary components.

In submergible pumping systems of the type described above, centrifugal pumps are commonly employed for producing the wellbore fluids. While in many applications such pumps provide sufficient lift and adequate efficiencies, a number of applications exist where their performance is less than satisfactory. In particular, in wells producing heavy or viscous fluids, centrifugal pumps may not develop sufficient pressure head to adequately displace the fluids through the production conduit. Moreover, depending upon well production rates, it may be desirable to vary the flow rate of fluid displaced by the pump by adjusting the speed of the production pump. For example, depending upon availability of collection vessels, flow rates from the well formations and so forth, the well operator may desire to reduce production rates from the well during certain periods, and to increase production substantially during other periods. However, because centrifugal pumps are typically inefficient at lower speeds, their use in submergible pumping systems may limit the range of production rates available to the well operator, particularly at low speeds.

Alternative solutions to the use of centrifugal pumps have been proposed and are currently in use. In one known approach, a positive displacement pump, such as a progressive cavity pump is employed in the place of a centrifugal pump. Such pumps offer a significant advantage over centrifugal pumps in that they displace viscous fluids very effectively over a wide range of speeds, including at low speeds. However, unlike centrifugal pumps, which have very low starting torques that can be provided directly by a submergible electric motor, progressive cavity pumps require significantly higher torques within a low speed range. This high torque requirement poses problems both during starting of the pumping system and during periods when production rates are reduced to relatively low levels.

To provide sufficient starting and low speed torque for progressive cavity pumps, known submergible pumping systems for wells typically employ a gear reducer for increasing output torque of a submergible electric motor coupled to the pump. The gear reducer is specially designed to fit within the space constraints of the wellbore, and is positioned in an intermediate module between the electric motor and the progressive cavity pump. The electric motor is typically a polyphase induction motor, which may be driven by various control circuits capable of varying its running speed. Such circuits include conventional inverter drives and the like.

During operation, the gear reducer acts as a torque multiplier (and concomitantly as a speed reducer), permitting the progressive cavity pump to be started by the electric motor and to be driven at a reduced speed. However, gear reducers are typically employed with a fixed operating speed which is lower than may be desired during certain phases of operation. Moreover, even where a variable speed motor drive is used, such gear reducers limit the range of speeds at which the pump can be driven, typically making higher production rates unavailable. Consequently, while pumping systems employing gear reducer-driven progressive cavity pumps may offer sufficient torque for starting the pump and for pumping at lower speeds, they do not offer the well operator the flexibility to pump fluids from the well at both lower and higher flow rates.

There is a need, therefore, for an improved technique for pumping fluids from wells via submergible pumping systems. In particular, there is a need for a system capable of effectively controlling a progressive cavity pump over a wider range of speeds than can be attained by heretofore known control systems. There is also a particular need for a control technique for such pumps which reduces electrical power losses during operation, while providing sufficient power to satisfy the starting and low speed torque requirements of the pumps.

SUMMARY OF THE INVENTION

The present invention provides an innovative approach to the control of submergible pumping systems designed to respond to these needs. While the approach may be utilized with a variety of different types of pumps, it is particularly well suited to pumps having relatively high starting and low speed torque requirements. The technique is based upon the conversion of electrical power from a source to direct current power having electrical characteristics adapted to the desired speed or flow rate of the pumping system. The conversion is performed by a power supply circuit at the earth's surface. The power supply circuit is typically coupled to a source of electrical power, such as three-phase power. The direct current power output by the power supply circuit is transmitted to the submersible pumping system via a direct current bus. The direct current bus may include only two power conductors within a conventional shielding arrangement. The direct current power has an electrical parameter, preferably voltage, which is proportional to the speed or flow rate desired of the pumping system. The direct current bus is coupled directly to the pumping system. In a particularly preferred arrangement, the pumping system incorporates an electric motor, such as a brushless motor. A switching circuit is coupled electrically between the direct current bus cable and the motor, and switches the direct current power as required by the motor. The resulting system provides excellent low speed torque, while permitting operation over a wide range of speeds.

In accordance with a first aspect of the invention, a control system is provided for a submergible pumping unit positionable in a well. The pumping unit includes a pump for displacing fluids within the well and a submergible electric motor coupled to the pump. The control system includes a power supply circuit and a direct current bus cable. The power supply circuit is disposed outside the well and is configured to be electrically coupled to a source of alternating current electrical power. The power supply circuits converts the alternating current electrical power to direct current electrical power at desired voltage levels. The direct current bus cable is electrically coupled to the power supply circuit for transmitting direct current electrical power from the power supply circuit to the electric motor. The power supply circuit is also configured to control the voltage levels of the direct current electrical power transmitted to a motor via the cable to drive the pump at desired speeds proportional to the voltage levels.

In accordance with another aspect of the invention, a control system is provided for submergible pumping system which includes a pumping unit submergible in fluids within a well. The control system includes a command circuit, a power supply circuit, and a direct current bus cable. The command circuit is configured to receive an input command signal representative of a desired operational parameter of the pumping unit. The power supply circuit is coupled to the command circuit and is configured to receive alternating current electrical power from a source and to convert the alternating current electrical power to direct current electrical power. The direct current electrical power has a voltage level which is based upon the desired operational parameter. The direct current bus cable is coupled to the power supply circuit and to the pumping unit and transmits the direct current electrical power to the pumping unit. In a particularly preferred embodiment, the system further includes a switching circuit which is disposed within the well and coupled to the direct current bus cable into the motor. The switching circuit is configured to switch the direct current electrical power and to apply the power to the motor.

The invention also provides a method for controlling a submergible pumping system. In accordance with the method, a power supply circuit is electrically coupled to the pumping system via a direct current bus cable. The power supply circuit is disposed outside the well. The pumping system is then at least partially submerged in viscous fluids within the well. A command signal is generated representative of a desired operating parameter of the pump. Alternating current electrical power from a source is converted to direct current electrical power in the power supply circuit. The direct current electrical power has a voltage level which is based upon the command signal. The direct current electrical power is then transmitted to the pumping system via the direct current bus cable to energize the motor and drive the pump. In preferred arrangements, the operating parameter is either speed of the motor or the flow rate of the pump, and the voltage level is proportional to the respective operating parameter. In accordance with a particularly preferred method, the electric motor of a submergible pumping system is electrically coupled to a power supply system including a power supply circuit, a switching circuit, and a direct current bus cable. The power supply circuit is disposed outside the well, while the switching circuit is disposed adjacent to and electrically coupled to the electric motor. The direct current bus cable is electrically coupled between the power supply circuit and the switching circuit. The pumping system is then at least partially submerged in viscous fluid within a well. Alternating current electrical power is converted to direct current electrical power in the power supply circuit. An electrical parameter of the direct current electrical power is based upon a desired operating parameter of the pumping system. The direct current electrical power is applied to the switching circuit via the direct current bus cable. The direct current electrical power is switched in the switching circuit, and is applied to the motor to drive the pump. Operation of the switching circuit is preferably based upon feedback signals from a sensor which detects the rotational position of rotating element of the motor.

BRIEF DESCRIPTION OF THE DRAWINGS

The foregoing and other advantages and features of the invention will become apparent upon reading the following detailed description and upon reference to the drawings in which.

DETAILED DESCRIPTION OF SPECIFIC EMBODIMENTS

Figure 1:
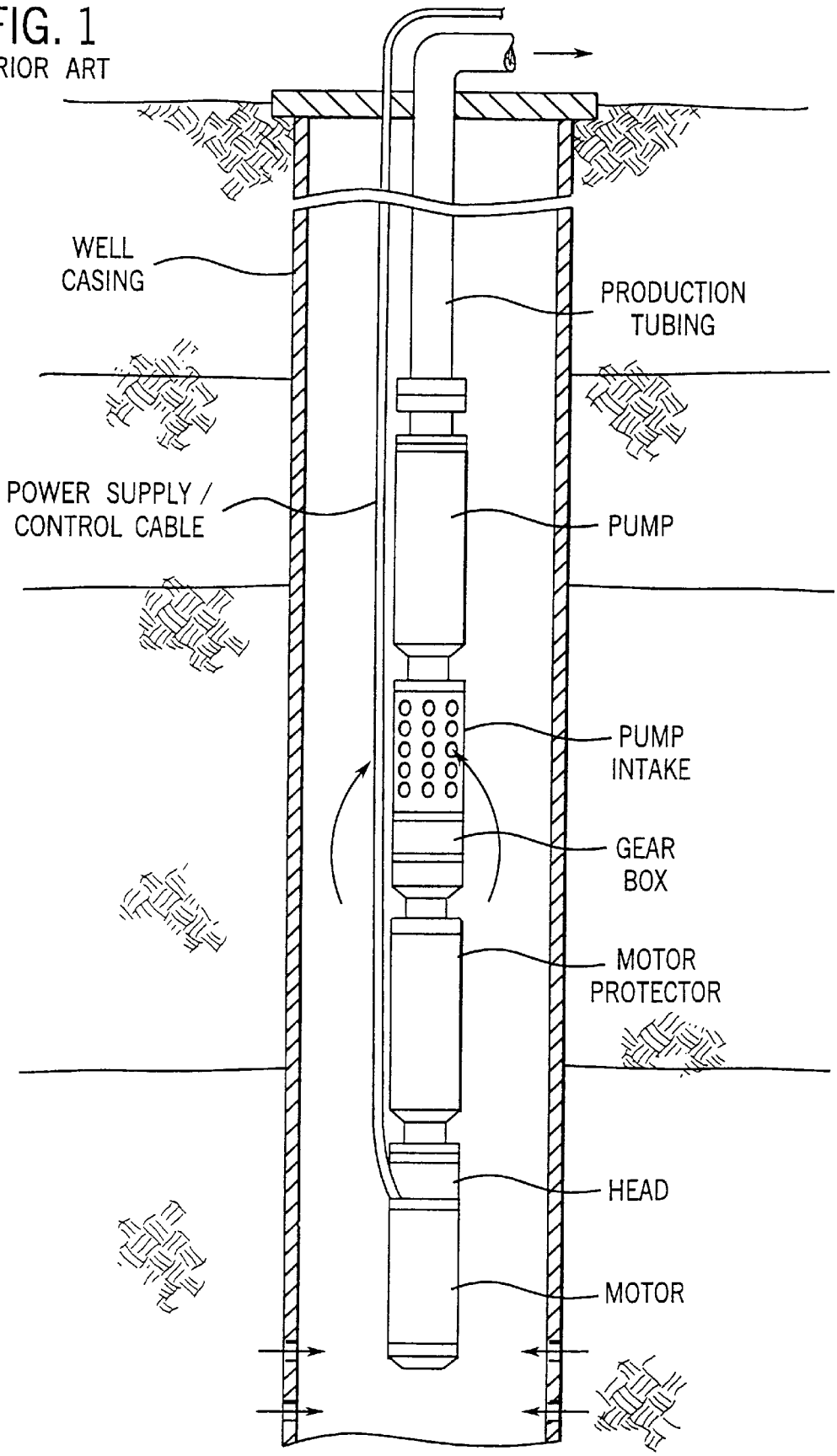
FIG. 1 PRIOR ART
FIG. 1 is an elevational view of an exemplary pumping system in accordance with the prior art shown positioned in a well for producing fluids therefrom.

Turning now to the Figures, and referring first to FIG. 1, a pumping system is illustrated for raising fluids from a well in accordance with a known prior art technique. The pumping system consists of progressive cavity pump having a lower inlet and an upper outlet coupled to production tubing. The production tubing extends from the pump to a location above the earth's surface for discharging fluids displaced by the pump. The pump is driven by a motor and an intermediate gear box positioned in-line between the motor and the pump. It should be noted that in practice the gear box is typically much longer than illustrated diagrammatically in FIG. 1, adding significantly to the overall mass and length of the system. The motor is coupled to a power supply and control cable which extends from the motor head to control circuitry (not shown) above the earth's surface.

In a typical installation, the electric motor is a conventional polyphase induction motor or similar machine, coupled to three-phase conductors provided in the power supply and control and control cable. Drive circuitry for the motor, which may typically include a conventional inverter drive, commands operation of the motor via the power supply and control cable. The motor is thus driven by controlled frequency AC power to rotate elements of the gear box and the pump. Because the progressive cavity pump has relatively high starting and low speed torque requirements, the gear box acts as a torque multiplier, permitting the motor to be started in a conventional manner. On the other hand, the gear box also acts as a speed reducer, significantly reducing the operational speed.

Figure 2:
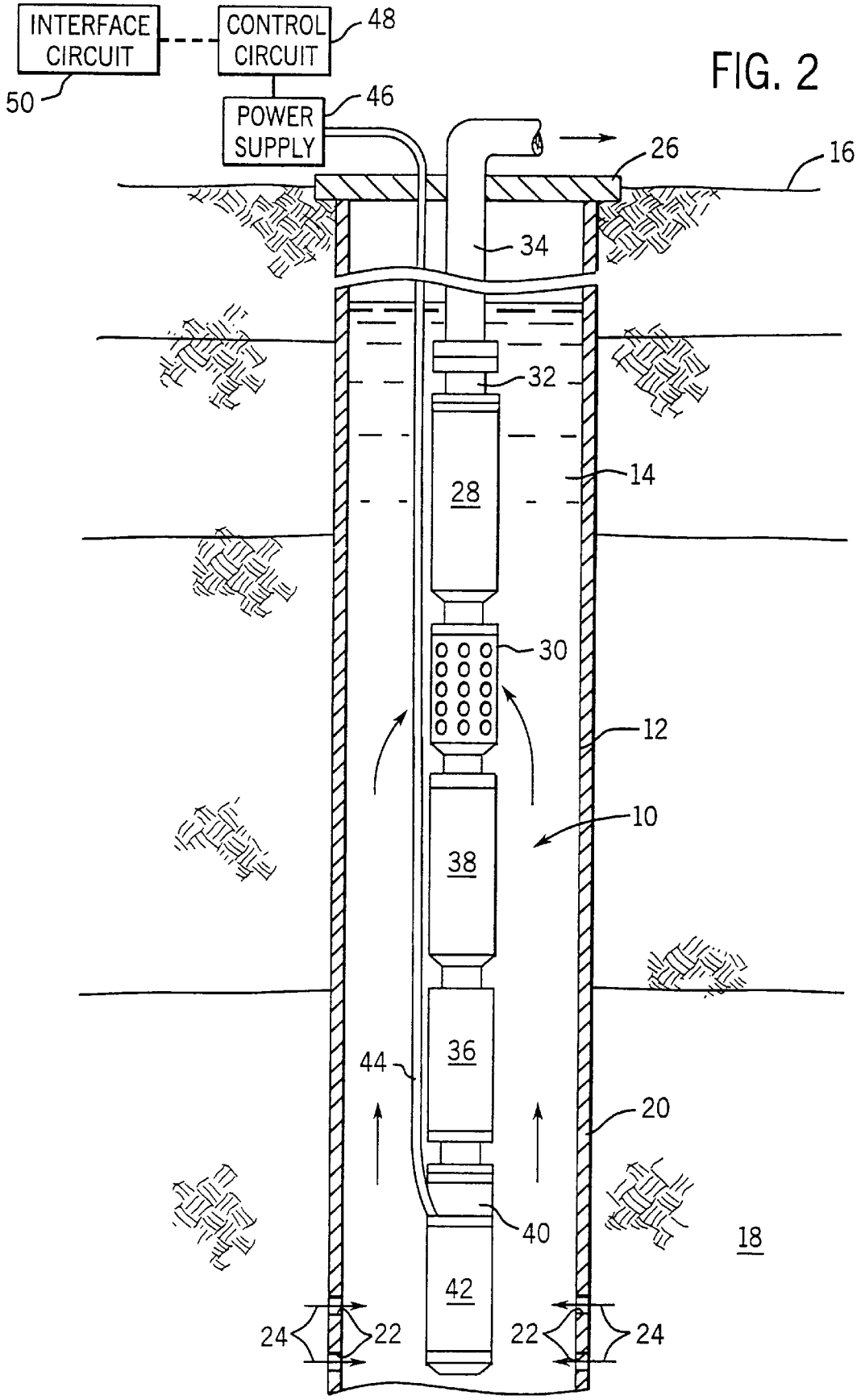
FIG. 2 is an elevational view of an exemplary embodiment of a submergible pumping system in accordance with certain aspects of the invention, including a progressive cavity pump coupled to an electric motor for driving the pump at various speeds as desired by a well operator.

FIG. 2 represents a pumping system and control in accordance with certain aspects of the inventive technique. In particular, FIG. 2 illustrates a pumping system, designated generally by the reference numeral 10, positioned in a wellbore 12, for pumping viscous fluids 14 from the wellbore to a location above the earth's surface 16. As will be appreciated by those skilled in the art, wellbore 12 will typically traverse a number of subterranean formations, including a production zone or horizon 18. Production zone 18 will include geological formations bearing production fluids of interest, such as oil, gas, condensate, paraffin waxes, and so forth. Wellbore 12 is bound by a well casing 20 through which production perforations 22 are formed in the vicinity of production zone 18. Perforations 22 permit fluid from zone 18 to flow into wellbore 12 as indicated by arrows 24. Such fluids will generally collect within wellbore 12 and are removed by pumping system 10 as described in greater detail below.

It should be noted that while in the illustrated embodiments pumping system 10 is shown and described as being deployed in a vertically oriented wellbore, the present technique is not limited to extraction of viscous fluids from vertical wellbores only. In particular, the technique described below may be employed in vertical, inclined and horizontal wellbores, including wellbores traversing one or more production zones. Similarly, the present technique can be employed in wells having one or more discharge zones, in which certain non-production fluids may be reinjected by appropriate pumping assemblies. Similarly, while the technique described below provides for the flow of wellbore fluids directly from production zone 18 into pumping system 10, alternative arrangements may be envisaged by those skilled in the art for directing flow to the pumping system, such as through the use of packers and other ancillary equipment for isolating portions of wellbore 12.

Returning to FIG. 2, pumping system 10 is deployed within wellbore 12 and coupled to equipment above the earth's surface 16 through a well head 26. Pumping system 10 includes a progressive cavity pump 28 having an inlet 30 and an outlet 32. Outlet 32 is preferably coupled to a stand of production tubing 34 which extends in wellbore 12 from progressive cavity pump 28 and through well head 26 to a collection or processing location (not shown) above the earth's surface. Production tubing 34 may include any suitable type of conduit, such as coil tubing. Where permitted by local regulations, pump 28 may force fluid to the earth's surface directly within casing 20 or within an annular area surrounding a conduit, with portions of pumping system 10 being isolated from inlet 30 via a packer or other equipment (not shown).

Progressive cavity pump 28 is driven by a submergible electric motor 36 coupled directly to pump 28 through a shaft extending through inlet 30. A motor protector 38, which may be of a generally known design, is preferably positioned between motor 36 and pump 28 to isolate internal portions of motor 36 from excessive pressure and temperature variations which may be experienced within wellbore 12. Such motor protectors are commercially available from Reda of Bartlesville, Okla.

Motor 36 is preferably a permanent magnet motor coupled via a connection head 40 to a switch unit 42. In a particularly preferred embodiment, motor 36 is a permanent magnet brushless motor having a plurality of stator coils and a ferromagnetic core about which a series of permanent magnets are secured in a manner known in the art. Connection head 40 permits a direct current bus cable 44 to be electrically coupled to switch unit 42 such that direct current electrical power can be supplied switch unit 42 from circuitry located above the earth's surface as described below. It should be noted that, while a permanent magnet brushless motor has been found to provide excellent torque and speed capabilities for driving progressive cavity pump 28, other suitable motors may be substituted for the permanent magnet brushless motor, where appropriate. Such motors may include conventional brush-type DC motors, switch-reluctance (SR) motors, and reluctance motors. As described in greater detail below, motor 36 preferably includes sensors, such as Hall effect sensors, for identifying the rotational position of the shaft of motor 36. Based upon this position, and upon direct current power transmitted to switch unit 42 via cable 44, switch unit 42 applies electrical power to motor 36 to drive pump 28 at desired speeds. It should be noted that because motor 36 is directly coupled to pump 28, pump 28 is forced to rotate at the same speed as motor 36. Motor 36 is thus driven so as to provide sufficient starting and low speed torques as required by pump 28.

Unit 42 is electrically coupled, through cable 44, to power supply and control circuitry located above the earth's surface. In the illustrated embodiment, such circuitry includes a power supply circuit 46 designed to receive alternating current power from a source and to convert the alternating current power to direct current power for powering pumping system 10. The preferred configuration of power supply circuit 46 will be described in greater detail below with reference to FIG. 4. In general, however, power supply circuit 46 is coupled to a control circuit 48, and receives command signals and default settings from control circuit 48 used to regulate the power supplied to pumping system 10. Control circuit 48 also preferably permits access to operating parameters of power supply circuit 46, such as voltage levels, current levels, and so forth for monitoring purposes.

Control circuit 48 is coupled to an interface circuit 50. Interface circuit 50, which preferably includes programmed personal computer or similar signal processing unit, a monitor, and input devices such as a keyboard, permits a well operator to input configuration values, set points, and so forth into control circuit 48. In the presently preferred embodiment, power supply circuit 46 and control circuit 48 are located in the vicinity of wellbore 12, such as in an equipment enclosure, operator's station or the like (not shown). Interface circuit 50 may be disposed local to control circuit 48 and power supply circuit 46, or may be remotely coupled to control circuit 48, such as via remote networking media, telephone systems, radio telemetry, and so forth. Thus, interface circuit 50 permits well operations personnel to monitor and command operation of pumping system 10 from either a local or remote location.

Figure 3:
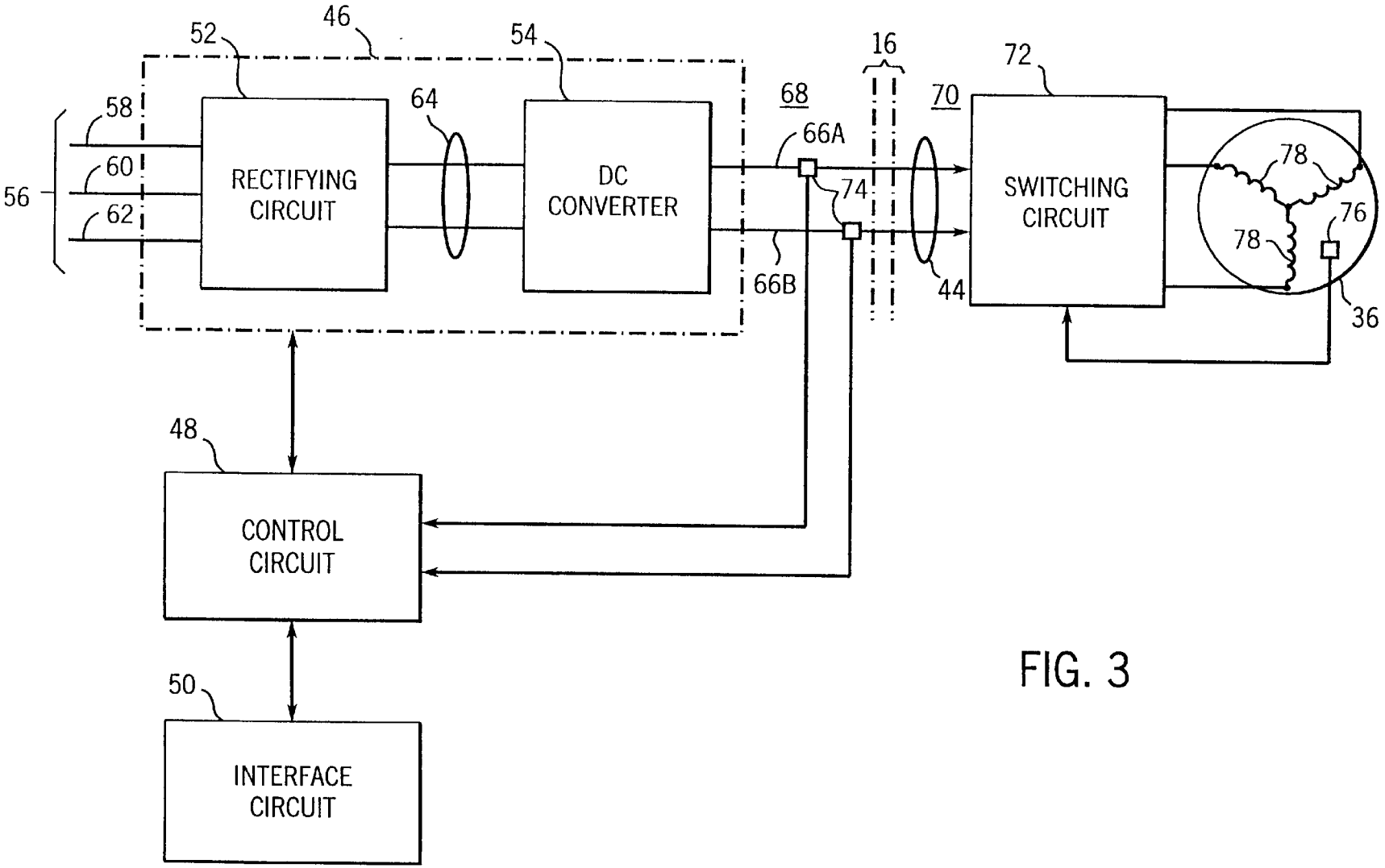
FIG. 3 is a diagrammatical view of certain functional components of the system illustrated in FIG. 2, including electronic circuitry disposed in the pumping system within the wellbore and additional circuitry disposed at the earth's surface.

FIG. 3 is a diagrammatical representation of signal flow paths between the power supply and drive components of FIG. 2. As shown in FIG. 3, power supply circuit 46 includes a rectifying circuit 52 and a DC converter circuit 54. Rectifying circuit 52, which is preferably a full wave bridge rectifier, receives three-phase alternating current power from a source 56 via power conductors 58, 60 and 62. Rectifying circuit 52 converts the incoming three-phase alternating current power to direct current power which is applied to DC converter 54 via an internal DC bus 64. DC converter 54, in turn, converts power received from rectifying circuit 52 to variable voltage DC power, preferably having a voltage range from 0 to 1000 volts, which is applied to a high-side conductor 66A and a low-side conductor 66B of cable 44. Conductors 66A and 66B are preferably number 4 AWG multi-strand conductors which are insulated and encapsulated in an armor shield in a manner generally known in the art. It should be noted that while heretofore known pumping systems traditionally employ three-conductor cables for transmitting three-phase AC power to a submergible pumping system, because power supply circuit 46 applies DC power to pumping system 10, bus cable 44 may include only a pair of conductors 66A and 66B, thereby reducing the weight, space requirements, and cost of the cable extended into wellbore 12.

Bus cable 44 extends from the earth's surface 16 to pumping system 10. As shown in FIG. 3, a portion of the control circuitry used to power motor 36 is therefore located above the earth's surface, as indicated by reference numeral 68 in FIG. 3, while certain portions of the circuitry are located below the earth's surface, as indicated by reference numeral 70 in FIG. 3. Bus cable 44 delivers the variable voltage power output by DC converter 54 to a switching circuit 72 within switch unit 42 below the earth's surface. Moreover, voltage transducers 74 are coupled to conductors 66A and 66B to feed back the DC bus voltage to control circuit 48 as described in greater detail below.

Switching circuit 72 receives the variable voltage direct current power output by DC converter 54 via bus cable 44. Switching circuit 72, which is housed within switch unit 42, converts the direct current electrical power to electrical power for driving motor 36. Sensors, represented generally by reference numeral 76 in FIG. 3, detect the rotational position of the shaft of motor 36 and feed back position data to switching circuit 72. Based upon the power received via bus cable 44 and upon the feedback signals from sensors 76, switching circuit 72 generates electrical power which is applied to windings 78 of motor 36.

Figure 4:
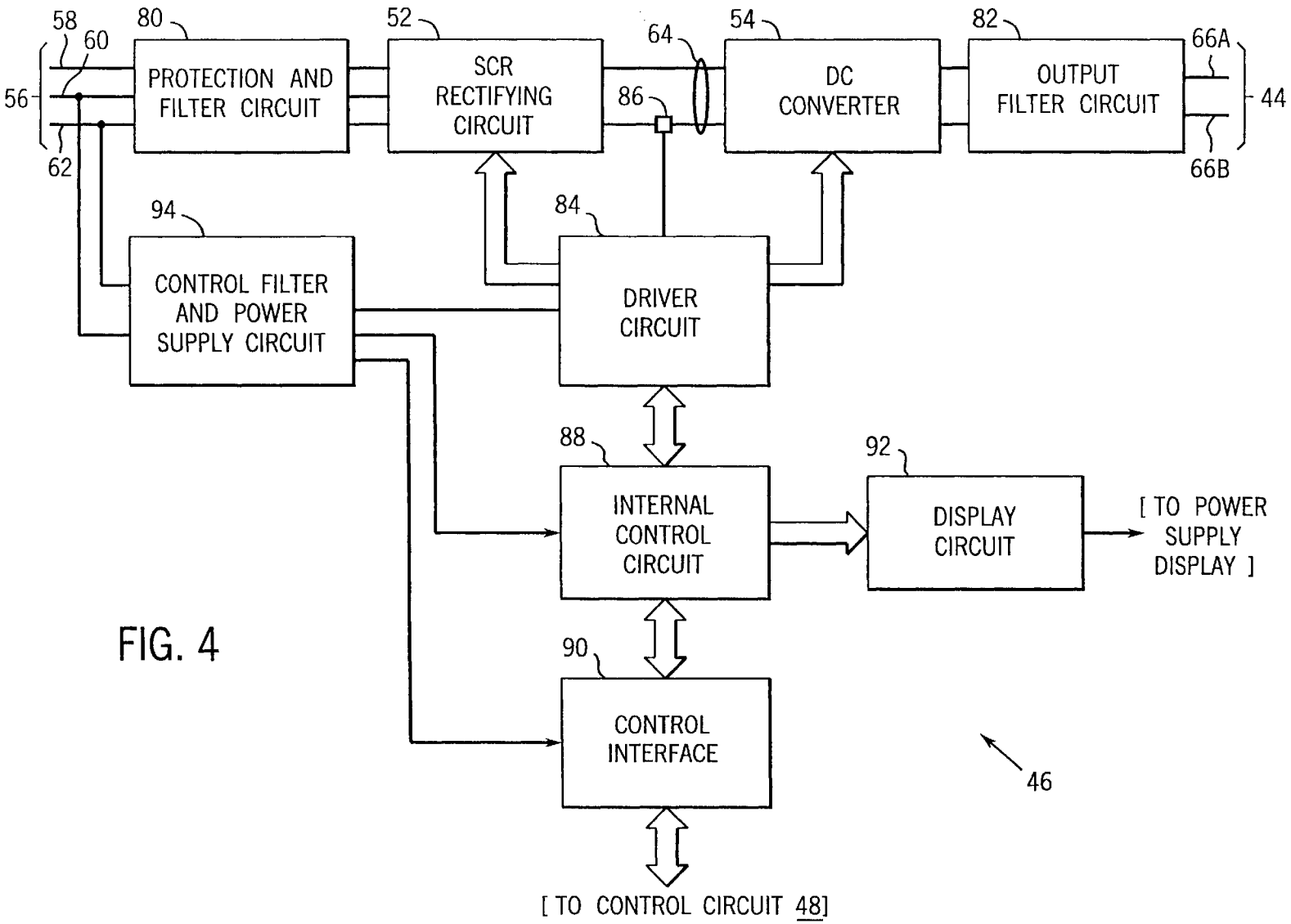
FIG. 4 is a diagrammatical representation of the circuitry included in a power supply of the system illustrated in FIG. 3 in accordance with a particularly preferred embodiment.

FIG. 4 is a diagrammatical representation of exemplary circuitry included in a preferred configuration of power supply circuit 46. As shown in FIG. 4, power supply circuit 46 includes rectifying circuit 52 coupled to DC converter circuit 54 via internal DC bus 64, as described above. In addition, power supply circuit 46 includes a protection and filter circuit 80 configured to be coupled to incoming three-phase power conductors 58, 60 and 62. Protection and filter circuit 80 preferably provides fused protection, and voltage and current overload circuitry of a type generally known in the art. Circuit 80 transmits power from conductors 58, 60 and 62 to rectifying circuit 52. Rectifying circuit 52 preferably includes a full wave bridge rectifier comprising a series of six silicone controlled rectifiers (SCRs) which convert the three-phase power to direct current power. Direct current power from circuit 52 is transmitted to DC converter 54, which preferably includes a set of insulated gate bipolar transistors (IGBTs) for converting constant voltage DC power transmitted through internal DC bus 64 to variable voltage DC power and for regulating current levels of the DC power. In the presently preferred arrangement, DC converter circuit 54 is capable of generating variable voltage DC output power within a voltage range of 0 to 1000 volts DC, and within a range of current between 0 and 110 amps. The power output by DC converter circuit 54 is routed through an output filter circuit 82, which preferably includes capacitive filtering of the output voltage to reduce unwanted variations in the voltage level. The foregoing component circuits, interconnected to form a variable voltage power supply, are commercially available from various manufacturers, including Magna-Power Electronics, Inc. of Boonton, N.J.

Power supply circuit 46 also includes command circuitry for coordinating operation of rectifying circuit 52 and DC converter circuit 54. As illustrated in FIG. 4, this circuitry includes a driver circuit 84, an internal control circuit 88, a control interface circuit 90, and a display driver circuit 92. Driver circuit 84 receives control signals from internal control circuit 88 for timing switching of the SCRs comprising rectifying circuit 52. In addition, driver circuit 84 receives command signals from internal control circuit 88 which control timing for switching of IGBTs located within DC converter circuit 54. As will be appreciated by those skilled in the art, by appropriately regulating the timing of the these solid state switching devices, internal control circuit 88 and driver circuit 84 produce a direct current output voltage which is substantially equal to or, or proportional to an input control signal from control interface circuit 90. Control interface circuit 90 receives such control or configuration signals from control circuit 48. In the presently preferred configuration, internal control circuit 88 includes a signal processing circuit configured by appropriate programming code, to regulate the output voltage of power supply 46 to match an input control signal received through control interface circuit 90.

It should be noted that, while the control signal applied to internal control circuit 88 may be representative of the actual voltage output along conductors 66A and 66B, the control signal could alternatively be representative of an operating parameter other than voltage. In particular, in a particularly preferred embodiment, control circuit 48 may receive commands from interface circuit 50 which are expressed in terms of flow rate from pump 28, or in terms of the speed of pump 28 and motor 36. Because pump 28 is a positive displacement pump, the flow rate of fluid displaced by the pump is related to the speed of the pump by a pump curve which will typically be known for the pump selected. The speed/flow rate relationship defined by the pump curve may be stored in the form of a "look-up table" to produce desired levels of flow rate in a repeatable manner (see FIG. 7 and the discussion relating to FIG. 7 below). Moreover, because the speed of rotation of pump 28 and motor 36 is preferably proportional to the output voltage of power supply 46, either internal control circuit 88, or control circuit 48 may be programmed to account for the relationship between the voltage applied to pumping system 10 by power supply circuit 46, and the ultimate output flow rate of pump 28. In the presently preferred embodiment, control circuit 48 is programmed to convert either the desired speed of motor 36 or the flow rate from pump 28 into a voltage command signal which is applied to internal control circuit 88 via control interface circuit 90. Based upon this command signal, internal control circuit 88 regulates switching commanded through driver circuit 84 to produce the desired voltage output level.

A current transducer 86 is preferably linked to internal DC bus 64 to provide driver circuit 84 with an indication of the current through the internal DC bus. As voltage changes are sensed by transducers 74 (see FIG. 3) and communicated to control circuit 48, control circuit 48 provides a current command to internal control circuit 88 via control interface circuit 90 to regulate the current applied to motor 36. The current command received by internal control circuit 88 is applied to driver circuit 84, which regulates operation of DC converter 54 to provide the desired level of current output along conductors 66A and 66B. Thus, power supply circuit 46 and control circuit 48 are configured to apply direct current output power along cable 44 having voltage levels which are proportional to the desired speed or flow rate from pumping system 10, and having current levels capable of driving pump 28 despite variations in pressure head or load on the pump.

As illustrated in FIG. 4, internal control circuit 88 is also coupled to a display circuit 92 which is capable of interfacing with internal control circuit 88 to provide configuration and monitoring information for an operator. Display circuit 92 preferably includes an integral push-button keyboard through which an operator can request configuration and operating parameter data, scroll through programming code, and so forth. Display circuit 92 outputs operator-readable data through an appropriate power supply display (not shown). In addition, driver circuit 84, internal control circuit 88 and control interface circuit 90 are coupled to a control filter and supply circuit 94 which provides power required for their operation. Circuit 94 is coupled to incoming power conductors 60 and 62 and is operative to convert, step down, and filter incoming power from the source of alternating current power to the appropriate levels required for the internal circuitry of power supply 46.

Figure 5:
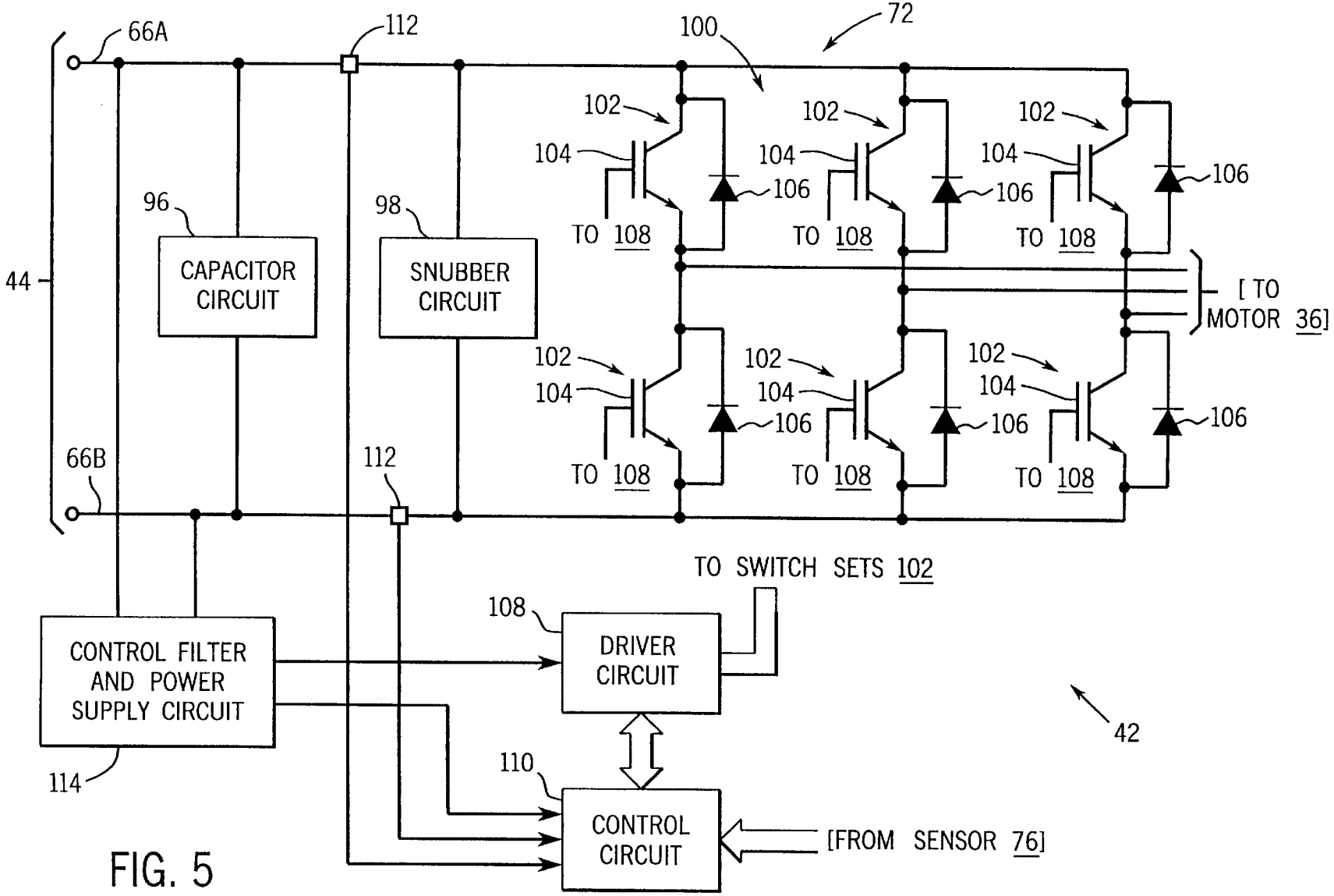
FIG. 5 is a diagrammatical illustration of circuitry included in a downhole portion of the system represented in FIG. 3 in accordance with a preferred embodiment.

FIG. 5 is a diagrammatical representation of a presently preferred configuration switch unit 42. As shown in FIG. 5, switch unit 42 includes switching circuit 72, coupled across high and low sides of the DC bus lines coupled to conductors 66A and 66B of cable 44. In the presently preferred arrangement, unit 42 includes a capacitive circuit 96 coupled across the DC bus, as well as a snubber circuit 98, similarly coupled across the DC bus. Capacitor circuit 96 is operative to smooth variations in voltage across the bus, while snubber circuit 98 reduces voltage spikes during switching of the components of switching circuit 72. Switching circuit 72 forms an inverter, designated generally by the reference numeral 100, which includes 6 switching sets 102 coupled as illustrated in FIG. 5 between high side 66A and low side 66B of the DC bus, and output lines coupled to motor 36. Each switching set, in turn, includes a power electronic switch 104, such as an IGBT, coupled in parallel with a flyback diode 106.

The base of each switch 104 is coupled to a driver circuit 108 which applies a signal to the base of the switch to convert direct current power provided over the DC bus to power for application to motor 36. Driver circuit 108 is controlled by a control circuit 110 which provides timing for the switching of switch sets 102. Control circuit 110 receives feedback signals from sensors 76, which provide an indication of the rotational position of the shaft of motor 36. As will be appreciated by those skilled in the art, control circuit 110 then regulates switching of sets 102 to direct power through the windings 78 of motor 36 and thereby to drive motor 36 at a speed proportional to the voltage applied across the DC bus. Additional transducers, represented generally at reference numeral 112, include voltage and current feedback transducers coupled to high and low sides 66A and 66B of the DC bus. Signals from these transducers are also applied to control circuit 110, which preferably includes appropriate coding for interrupting operation of motor 36 in the event of an overcurrent or overvoltage condition. A control filtering and power supply circuit 114 is coupled to high and low sides 66A and 66B of the DC bus to step down and regulate power for operation of driver circuit 108 and control circuit 110.

Figure 6:
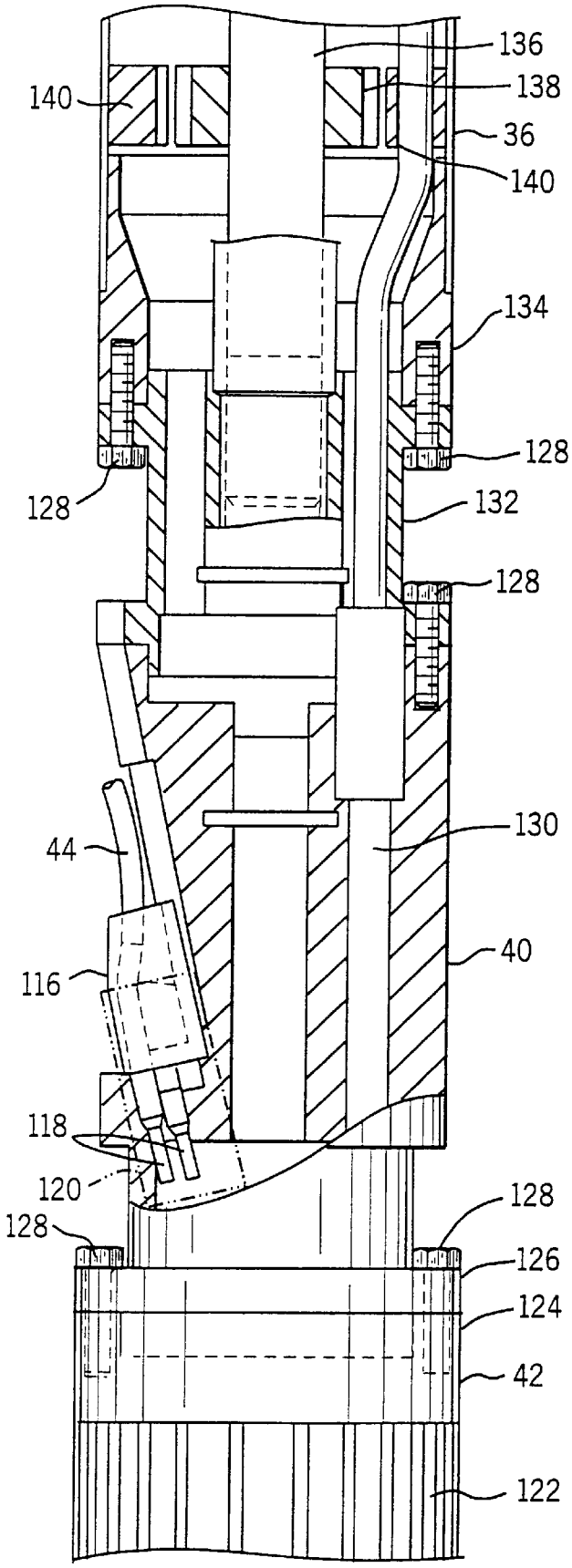
FIG. 6 is a partial sectional view of a presently preferred electronic module connection head for coupling the circuitry shown in FIG. 5 to a power supply bus cable.

FIG. 6 is a partially sectioned view of a portion of pumping system 10 illustrating a preferred manner in which incoming power is transmitted to connection head 40 via cable 44. As shown in FIG. 6, two-conductor DC bus cable 44 terminates in a cable plug 116 having a pair of conductive pins 118 extending therefrom. A receptacle 120, illustrated in broken lines in FIG. 6, is provided in connection head 40 for sealingly receiving cable plug 116 and for completing current carrying paths between the conductors of cable 44 and the circuitry illustrated in FIG. 5. The circuitry illustrated in FIG. 5 is preferably supported on conventional printed circuit boards which are mounted within a pressure-tight housing 122. Housing 122 has an upper flanged end 124 which is sealingly secured to connection head 40 via fasteners 128. Electrical signals are output by the circuitry contained within housing 122 through conductors disposed in an internal passage 130 extending through connection head 40 (conductors have been removed in FIG. 6 for simplicity). A flanged intermediate section 132 is provided between motor 36 and connection head 40 to facilitate securing of the motor to connection head 40. Intermediate section 132 is sealingly secured to a lower flanged end 134 of motor 36 via fasteners 128. Also as may be seen in FIG. 6, shaft 136 of motor 36 includes, at its lower end, a sensing magnet assembly 138, which is secured to the motor shaft 136 and rotates therewith. Hall effect sensors 140 are provided adjacent to sensing magnet assembly 138 to detect the rotational position of shaft 136 during operation of motor 36. Signals representative of the position of shaft 136 are fed back to control circuit 110 of switch unit 42 as summarized above (see FIG. 5).

With power supply circuit 46 and switch unit 42 configured as described above, pumping system 10 is driven and controlled as follows. For starting, the system is first enabled by a start signal from interface circuit 50 (see FIG. 3). Based upon a preset voltage, speed or flow rate command signal stored within control circuit 48, power supply circuit 46 produces a matching direct current voltage and applies the voltage to the conductors 66A and 66B of DC bus cable 44, thereby driving motor 36 and pump 28 from a static condition to a desired speed corresponding to the applied DC voltage. Because motor 36 is directly coupled to pump 26, both are driven at equal speeds in rotation. Subsequent changes in the speed or flow rate of pumping system 10 may be affected by inputting the desired speeds or flow rates into interface circuit 50. Control circuit 48 then converts the speeds or flow rates into the required voltage power levels and commands power supply circuit 46 to regulate output power to match the desired speeds or flow rates. For stopping the system, a stop signal may be input to interface circuit 50. Similarly, a protection shut down alarm may be configured in the system, such as for stopping operation when an overpressure, overcurrent, overvoltage or other undesirable condition is sensed. Control circuit 48 treats the stop signal as a zero speed command and power supply circuit 46 is phased back to slow motor 36 and pump 28 to a static condition. When current drawn by motor 36, as sensed within power supply 46, indicates that motor 36 has stopped, a corresponding signal is conveyed to control circuit 48 and to interface circuit 50 to acknowledge that the unit is once again static.

In addition to the configuration features summarized above, power supply circuit 46 is also preferably configured to compensate for a voltage drop in the DC bus cable 44. As will be appreciated by those skilled in the art, such voltage drop will generally be proportional to the product of the square of current applied to motor 36 and the resistance of the conductors of cable 44. Moreover, power supply circuit 46 is preferably configured to provide protection in the event of short circuits between output conductors 66A and 66B, as well as between each conductor and ground. As summarized above, power supply circuit 46 also provides for protection against overvoltage and overcurrent conditions. Power supply circuit 46 may also advantageously provide for monitoring and protection against logic power supply failure, loss of input power, loss of one phase of input power, short circuit or fault on the input power, and so forth.

Interface circuit 50 and control circuit 48 are also preferably configured to receive a variety of parameter settings, including current limits, motor speed limits, overload duration limits, and values of DC bus cable electrical resistance. Interface circuit 50, through control circuit 48 and power supply circuit 46 preferably provides operator accessible data relating to motor current based upon DC current measurement within power supply circuit 46, protection shut down acknowledgment, voltage levels output along DC bus cable 44, and system shut down data.

Similarly, control circuit 110 of switch unit 42 is also preferably configured to receive data and monitor operating conditions of pumping system 10. In particular, control circuit 110 preferably provides for protection against loss of input power, loss of one line of power from cable 44, as well as for short circuits between the conductors of cable 44 and between a single conductor and ground. Control circuit 110 preferably also provides automatically resetting overvoltage, overload and, overcurrent protection for motor 36, and shuts down power to motor 36 upon the loss of position sensor information.

While in the preferred embodiment described above, the circuitry associated with pumping unit 10 is designed to control speed and flow rate independent of separate feedback signals from the pumping system, where desired, signals representative of operating parameters of pumping system 10 may be transmitted to the above ground circuitry as desired. In particular, switch unit 42 may include circuitry for storing and transmitting parameter signals representative of speed, voltage levels, current levels, temperatures, and so forth. Such signals may be transmitted to the above ground control circuitry via a data transmission conductor placed within cable 44 or may be transmitted via alternative techniques such as radio telemetry. Such signals may be stored within control circuit 48 and made available to interface circuit 50 for remote monitoring of the actual operating conditions within wellbore 12.

Figure 7:
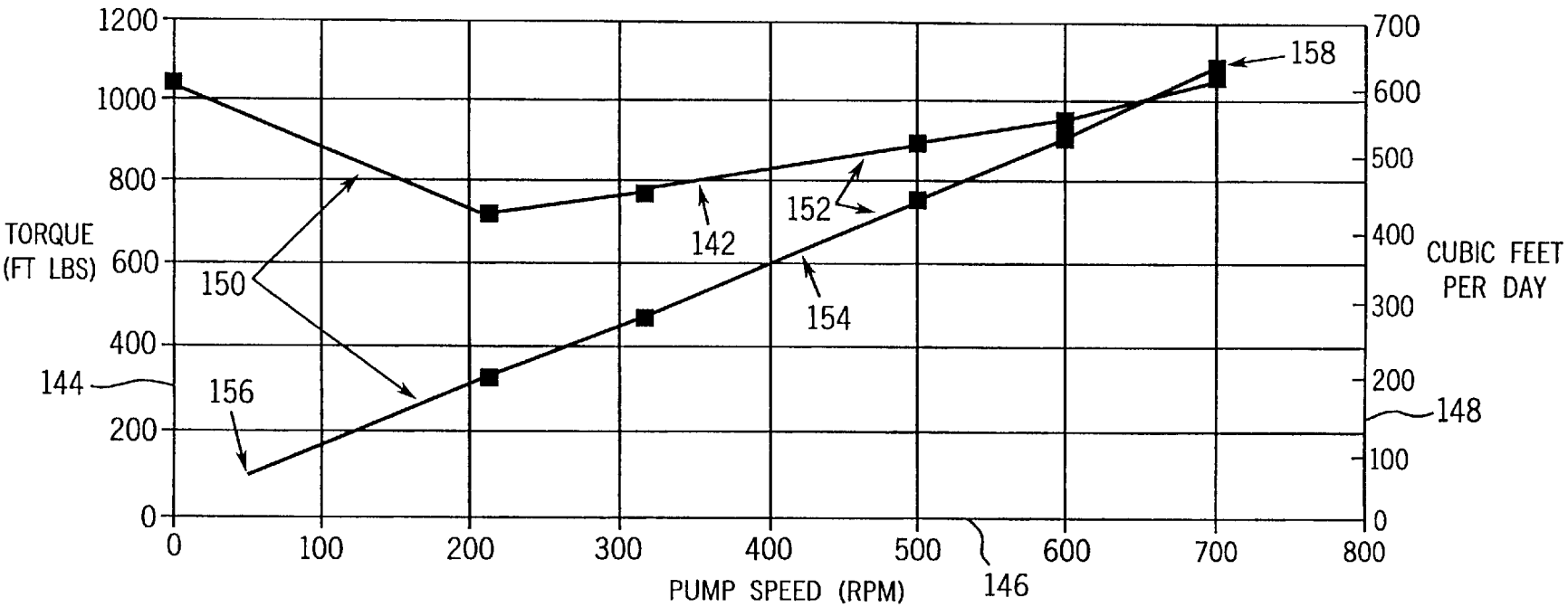
FIG. 7 is a graphical representation of speeds and flow rates available from a pumping and control system of the type illustrated in FIGS. 2 through 6.

FIG. 7 is a graphical representation of an exemplary torque-speed and speed-flow curves for a pumping system 10 driven by the foregoing circuitry. In the example graphically represented in FIG. 7, pump 28 was a series 31, model 31-1800 progressive cavity pump available from BMW Pump Inc. of Lloydminster, Alberta, Canada. The pump was driven by an 80 horsepower electric motor within a speed control range of 0–800 rpm, and within an operating torque range of up to 1100 ft-lb. The pump has a starting torque well in excess of the continuous running torque, the drive system being rated at 150% full load torque during starting. Maximum motor current was 110 amps and the input voltage range was from 0–1000 volts DC.

As shown in FIG. 7, a torque-speed curve 142 was generated for the pump over a wide range of operating speeds and corresponding flow rates. In FIG. 7, a left hand vertical axis 144 represents the torque in ft-lbs., the horizontal axis represents pump speed in rpm, while the right hand vertical axis represents flow rate in cubic feet per day. With the pump being started from a static condition, voltage was applied to the motor over the DC bus cable to overcome the initial starting torque of approximately 1050 ft-lbs. Trace 150 represents a torque-speed curve for the pump from starting to a maximum rated speed. As speed was increased over a low speed range 150, torque requirements dropped to approximately 725 ft-lbs. at a speed of approximately 210 rpm. Thereafter, the torque increased substantially linearly over a higher speed range 152. Trace 154 in FIG. 7 represents a speed-flow curve for the pump and motor assembly. As shown, as speed is increased from a lower limit speed 156, of approximately 50 rpm to a maximum speed of approximately 700 rpm, flow from the pumping unit increases substantially linearly. It should be noted that, because in the preferred embodiment described above speed of the motor and pump is directly proportional to the voltage level applied via the DC bus cable, a voltage-flow curve or a voltage-speed curve would assume substantially the same profile. As will be appreciated by those skilled in the art, the foregoing system permits the progressive cavity pump to be started directly from a static condition by applying sufficient direct current voltage to switch unit 42 to overcome the starting torque of the pump. Thereafter, flow rate is adjustable within the full operating range of the pump as desired by the well operator to obtain both low flow rates and elevated flow rates, as required.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims. For example, while in the described embodiment, the power supply circuitry is configured to receive alternating current power from a source and to convert such power to variable voltage direct current power, a power supply circuit may be provided which generates or receives direct current power from a source, converting the direct current power to the variable voltage power used to drive the motor.

What is claimed is:

1. A control system for a submergible pumping unit positionable in a well, the pumping unit including a pump for displacing fluids within the well and a submergible electric motor coupled to the pump for driving the pump, the control system comprising:

a power supply circuit disposed outside the well, the power supply circuit being configured to be electrically coupled to a source of alternating current electrical power and to convert the alternating current electrical power to direct current electrical power at desired voltage levels; and a direct current bus cable electrically coupled to the power supply circuit for transmitting direct current electrical power from the power supply circuit to the electric motor;

wherein the power supply circuit is further configured to control the voltage levels of the direct current electrical power transmitted to the motor via the cable to drive the pump at desired speeds proportional to the voltage levels.

2. The control system of claim 1, further comprising a switching circuit disposed within the well and electrically coupled to the direct current bus cable and to the motor, the switching circuit being configured to apply the direct current electrical power from the power supply circuit to the motor.

3. The control system of claim 2, wherein the electrical motor is a permanent magnet brushless motor.

4. The control system of claim 3, wherein the pump is a progressive cavity pump and the power supply circuit is configured to transmit direct current electrical power to the pumping unit at voltage levels sufficient to start the pump from a static condition.

5. The control system of claim 1, wherein the direct current bus cable is a two conductor cable extending from the power supply circuit to the pumping unit.

6. The control system of claim 1, further comprising an operator interface circuit coupled to the power supply circuit for commanding operational parameters of the power supply circuit.

7. A control system for a submergible pumping system positionable in a well, the pumping unit submergible in fluids within the well including a pump and an electric motor operatively coupled to the pump, the control system comprising:

a command circuit configured to receive an input command signal representative of a desired operational parameter of the pumping unit;

a power supply circuit coupled to the command circuit, the power supply circuit being configured to receive alternating current electrical power from a source and to convert the alternating current electrical power to direct current electrical power having a voltage level based upon the desired operational parameter; and a direct current bus cable coupled to the power supply circuit and to the pumping unit for transmitting the direct current electrical power to the pumping unit.

8. The control system of claim 7, wherein the operational parameter is the direct current voltage applied to the pumping unit via the bus cable.

9. The control system of claim 7, wherein the operational parameter is flow rate of fluid from the pump.

10. The control system of claim 7, wherein the operational parameter is speed of the pump.

11. The control system of claim 7, wherein the voltage level is proportional to the input command signal.

12. The control system of claim 7, wherein the bus cable is a two conductor shielded cable.

13. The control system of claim 7, further comprising a switching circuit disposed within the well and coupled to the direct current bus cable and to the motor, the switching circuit being configured to apply the direct current electrical power to the motor.

14. A control system for a submergible pumping system, the pumping system including a pump operatively coupled to an electric motor, the pumping system being positionable within a well to pump viscous fluid from the well, the control system comprising:

a power supply circuit configured to provide variable voltage direct current power having a voltage level proportional to a desired speed of the pump; and a direct current bus cable electrically coupled to the power supply circuit and to the pumping system, the direct current bus cable applying the variable voltage direct current power to the pumping system for driving the pump at the desired speed.

15. The control system of claim 14, further comprising a switching circuit disposed within the pumping system, the switching circuit receiving the variable voltage direct current power and applying the power to the electric motor.

16. The control system of claim 14, wherein the power supply circuit is configured to receive alternating current electrical power from a source and to convert the alternating current electrical power to the variable voltage direct current power.

17. A method for controlling a submergible pumping system, the system including a pump operatively coupled to an electric motor, the system being positionable within a well to pump viscous fluid within the well, the method comprising the steps of:

(a) electrically coupling a power supply circuit to the pumping system via a direct current bus cable, the power supply circuit being disposed outside the well;

(b) at least partially submerging the pumping system in the viscous fluids within the well;

(c) generating a command signal representative of a desired operating parameter of the pump;

(d) converting alternating current electrical power from a source to direct current electrical power in the power supply circuit, the direct current electrical power having a voltage level based upon the command signal; and (e) transmitting the direct current electrical power to the pumping system via the direct current bus cable to energize the motor and drive the pump.

18. The method of claim 17, wherein the operating parameter is speed of the motor and the voltage level is proportional to the speed.

19. The method of claim 17, wherein the operating parameter is flow rate from the pump and the voltage level is proportional to the flow rate.

20. The method of claim 17, wherein the pumping system includes a switching circuit coupled to the direct current bus cable and to the motor, and wherein step (e) includes the steps of applying the direct current electrical power to the switching circuit and applying the electrical power from the switching circuit to the motor.

21. The method of claim 20, wherein the switching circuit is operatively coupled to a sensor configured to detect rotational position of a rotating element of the motor and to generate feedback signals representative thereof, and wherein applying the direct current electrical power to the electric motor is based upon the feedback signals.

22. A method for controlling a submergible pumping system including an electric motor operatively coupled to a pump, the system being submergible in viscous fluids within a well for pumping the fluids from the well, the method comprising the steps of:

(a) electrically coupling the electric motor to a power supply system, the power supply system including a power supply circuit disposed outside the well, a switching circuit disposed adjacent to and electrically coupled to the electric motor, and a direct current bus cable electrically coupled between the power supply circuit and the switching circuit;

(b) at least partially submerging the pumping system in the viscous fluid;

(c) converting alternating current electrical power to direct current electrical power in the power supply circuit, an electrical parameter of the direct current electrical power being based upon a desired operating parameter of the pumping system;

(d) applying the direct current electrical power to the switching circuit via the direct current bus cable; and (e) applying the direct current electrical power to the electric motor from the switching circuit.

23. The method of claim 22, wherein the electrical parameter is voltage and the desired operating parameter is speed of the motor.

24. The method of claim 22, wherein the electrical parameter is voltage and the desired operating parameter is flow rate from the pump.

25. The method of claim 22, wherein the motor includes a sensor for detecting rotational position of a rotating element of the motor and for generating feedback signals representative thereof, and wherein operation of the switching circuit in step (e) is based upon the feedback signals.

26. The method of claim 22, wherein the power supply circuit is coupled to an interface circuit and the method includes the further steps of generating a command signal representative of the desired operating parameter, and applying the command signal to the power supply circuit via the interface circuit.

27. A method for controlling a submergible pumping system including an electric motor operatively coupled to a pump, the system being submergible in a viscous fluid within a well for pumping the fluid from the well, the method comprising the steps of:

(a) electrically coupling a power supply circuit to the pumping system via a direct current bus cable, the power supply circuit being disposed outside the well;

(b) at least partially submerging the pumping system in the viscous fluid within the well; and (c) applying variable voltage direct current power from the power supply circuit to the pumping system to drive the pump at a desired speed.

28. The method of claim 27, wherein the power supply circuit is configured to receive alternating current electrical power from a source and to convert the alternating current electrical power to the variable voltage direct current power.

29. The method of claim 27, wherein the pumping system includes a switching circuit, the switching circuit receiving the variable voltage direct current power via the direct current bus cable and applying the direct current power to the motor.

30. The method of claim 27, including the further steps of generating a command signal based upon the desired speed and applying the command signal to the power supply circuit, and wherein the power supply circuit outputs the variable voltage direct current power at a voltage level based upon the command signal.

* * * * *